US008469259B2

(12) United States Patent
Clement et al.

(10) Patent No.: US 8,469,259 B2
(45) Date of Patent: Jun. 25, 2013

(54) PACKAGING FOR BAR-LIKE FOODSTUFFS

(75) Inventors: Roland Clement, Romanel sur Lausanne (CH); Marie-Dominique Nallet, Nogent-sur Marne (FR)

(73) Assignee: Nestec S.A., Vevey (CH)

( * ) Notice: Subject to any disclaimer, the term of this patent is extended or adjusted under 35 U.S.C. 154(b) by 394 days.

(21) Appl. No.: 12/681,200

(22) PCT Filed: Oct. 1, 2008

(86) PCT No.: PCT/EP2008/008317

§ 371 (c)(1),
(2), (4) Date: Apr. 1, 2010

(87) PCT Pub. No.: WO2009/043575

PCT Pub. Date: Apr. 9, 2009

(65) Prior Publication Data

US 2010/0288825 A1 Nov. 18, 2010

(30) Foreign Application Priority Data

Oct. 2, 2007 (CH) ..... 2007/000487

(51) Int. Cl.
*B65D 17/28* (2006.01)

(52) U.S. Cl.
USPC ..... 229/223; 229/103.3; 229/149; 229/247

(58) Field of Classification Search
USPC ..... 229/103.3, 149, 206, 223, 247
See application file for complete search history.

(56) References Cited

U.S. PATENT DOCUMENTS

| | | | | | |
|---|---|---|---|---|---|
| 2,117,281 | A | * | 5/1938 | Bravi | 53/395 |
| 3,270,946 | A | * | 9/1966 | Redpath et al. | 229/149 |
| 3,311,281 | A | * | 3/1967 | Eisman | 229/223 |
| 3,392,905 | A | * | 7/1968 | Caldwell | 229/103.3 |
| 3,443,740 | A | | 5/1969 | McKinney | |
| 3,524,580 | A | * | 8/1970 | Heyworth | 206/424 |
| 3,549,082 | A | * | 12/1970 | Simpson | 229/209 |

(Continued)

FOREIGN PATENT DOCUMENTS

| | | |
|---|---|---|
| CH | 692110 | 2/2002 |
| DE | 1030247 | 5/1958 |

(Continued)

OTHER PUBLICATIONS

International Search Report, PCT/EP2008/008317, mailed Dec. 10, 2008.

*Primary Examiner* — Gary Elkins
(74) *Attorney, Agent, or Firm* — K&L Gates LLP

(57) ABSTRACT

The invention relates to a packaging (1) for bar-like or bar-shaped foodstuffs, in particular for bars of chocolate, with a rectangular base (2), two side elements (3) which are arranged on opposite sides of the rectangular base (2), are separated from the base (2) via folding lines (5) and can be folded inwards along the folding lines (5), and a first and a second cover element (4.1, 4.2) which are arranged on the two other opposite sides of the rectangular base (2), separated from the latter via folding lines (5), and which partially overlap with the two side elements in the folded state. The first cover element (4.1) has a perforation (6) by means of which a flap (7) can be separated from a fixing region (9), and the second cover element (4.2) can be inserted into an opening (10) for re-closing of the packaging.

15 Claims, 2 Drawing Sheets

U.S. PATENT DOCUMENTS

| | | | | |
|---|---|---|---|---|
| 3,933,694 | A | 1/1976 | Wysocki | |
| 4,750,609 | A * | 6/1988 | Felis | 229/103.3 |
| 5,123,589 | A * | 6/1992 | Cote | 229/149 |
| 6,228,450 | B1 * | 5/2001 | Pedrini | 229/238 |
| 2005/0255198 | A1 | 11/2005 | Aldridge | |

FOREIGN PATENT DOCUMENTS

| | | | | |
|---|---|---|---|---|
| DE | 2507679 | | 1/1976 | |
| DE | 200610032008 | | 1/2008 | |
| EP | 1134615 | | 9/2001 | |
| EP | 1792832 | | 6/2007 | |
| EP | 2 030 913 | | 3/2009 | |
| GB | 1143858 | | 2/1969 | |
| GB | 2255545 | A * | 11/1992 | 229/103.3 |
| JP | 6-156479 | A * | 6/1994 | 229/247 |
| WO | 0023334 | | 4/2000 | |
| WO | 2006017601 | | 2/2006 | |
| WO | 2008006411 | | 1/2008 | |

* cited by examiner

PACKAGING FOR BAR-LIKE FOODSTUFFS

The invention lies in the field of packagings, in particular packagings made of cardboard or fifty percent cardboard material for bars of chocolate.

A very wide variety of packagings for chocolate bars, in particular made of paper, are known from the prior art.

German Patent publication DE 25 07 679 A1 of SIG Schweizerische Industrie-Gesellschaft shows a non-reclosable packaging made of paper for a bar of chocolate, in which a label which has a separable region is fixed on a flat side.

English Patent publication GB 1,143,858 of inventor Emil Egli shows a non-reclosable packaging for bars of chocolate, with a first, outer packaging made of paper and a second, inner, film-like packaging. The first packaging can be torn open and is connected to the second packaging in such a manner that, when the outer packaging is torn open, the inner packaging is likewise torn open.

A disadvantage of the two above packagings is the low stability of the packaging, which means that the chocolate bar may break if the packaging is subjected to a mechanical stress, i.e. the chocolate bars are not sufficiently protected.

U.S. Pat. No. 3,443,740 of the Kellogg Company shows a box-shaped cardboard packaging for breakfast cereals. A cover comprises a first element with a tongue and a second element with a slot-like opening into which the tongue can be inserted and the packaging can thereby be re-closed. However, this packaging is not suitable for chocolate bars and has low mechanical stability.

An object of the invention is to show a packaging which avoids the disadvantages of the prior art.

The object is achieved by the packaging defined in the independent patent claim.

Nowadays, in addition to the design- and advertising-specific aspects, diverse requirements are imposed on packagings for bar-like or bar-shaped foodstuffs, such as bars of chocolate. The packaging firstly has to have sufficient mechanical stability in order to protect the chocolate against mechanical influences, for example during transportation, during stacking or during handling by the consumer. For example, the chocolate bar should not break in the packaging. Furthermore, the packaging should be suitable with regard to handling to continue to protect the chocolate bar or parts thereof even after being opened for the first time and, in addition, should be, if appropriate, re-closable and/or secure against manipulation. Secondly, weight- and resource-optimized packagings which are produced with as little material outlay as possible are desired for economic reasons. It has been shown that meeting all of these requirements simultaneously is problematic.

All of the requirements can be taken into account simultaneously by means of a packaging according to the invention with a box-, case- or envelope-like structure. By means of various layouts of the packaging in the unfolded state, by means of various arrangements of the openable parts of the packaging and by means of various permutations as to where and how the packaging is operatively connected in the folded state in a dimensionally fixed or dimensionally stable manner with the smallest possible outlay, a very wide variety of embodiments can be realized, in which individual requirements are weighted to differing degrees or all of the requirements are optimized simultaneously.

One embodiment of a packaging according to the invention for bar-like chocolate is composed of cardboard or fifty percent cardboard material and has: a rectangular base, two side elements which are arranged on opposite sides or edges of the rectangular base, are separated from the base via folding lines and can be folded inwards along the folding lines, and a first and a second cover element which are each arranged on one of the two other opposite sides of the rectangular base, separated from the latter via folding lines. The cover elements partially overlap with the two side elements in the folded state. Furthermore, the first cover element has a perforation by means of which a flap can be separated from a fixing region and can be opened. The fixing region can be operatively connected in the closed state to the second cover element via first adhesive bonding points. The second cover element has an opening into which the flap or a tab of the flap can be inserted for reclosing of the packaging.

The perforation may be designed as an originality seal which is secured against manipulation and is visible from the outside. If the perforation is not entirely severed, i.e. if the flap is still connected to the fixing part via the perforation, a purchaser can assume that the packaging has not yet been opened, i.e. is unopened. Alternative embodiments to a perforation may be realized as slots which are arranged in the manner of steps or bricks, but in any case partially offset laterally, or as a tear-off tape.

As an alternative or in addition, the perforation may be replaced by one or more slots. In this case, the flap and the fixing region may be completely separated from each other. The flap and the fixing region are operatively connected to each other in the folded or closed, unopened state by means of a connection in the manner of an adhesively bonding strip. The connection in the manner of an adhesively bonding strip may lie directly between flap and fixing region or be realized by an adhesively bonding strip additionally fixed on the outside or inside of the packaging. It is possible for the connection in the manner of an adhesively bonding strip to be detached and re-adhered repeatedly.

The fifty percent cardboard material or cardboard used for the packaging may be single- or multi-layered and generally has a weight of 80 $g/m^2$ to 600 $g/m^2$. This ensures that the packaging has sufficient stability and mechanical strength and protects the packaged chocolate and the packaging, for example, against compressive forces and weight during stacking or against mechanical bending or shearing forces during handling. Instead of cardboard or a fifty percent cardboard material, other dimensionally stable, flexurally elastic composite materials which can be bent or deformed along folding lines and can be separated along a perforation, or materials, such as plastic films or metal foils, can also be used. Combinations of different materials are also possible.

In one embodiment, the packaging in the unfolded state has an approximately cross-like shape (layout) which can be produced as a single part by punching it out of a sheet of cardboard and with minimal cutting. Depending on the shape of the foodstuff to be packaged, other layouts are also possible, for example with a triangular, trapezoidal or polygonal base. The dimensional stability of the packaging in the folded state is achieved by adhesively bonding the various elements to form a box-like structure. This takes place by, for example, the fixing region being operatively connected to the second cover element and/or to the side elements via adhesive bonding or adhesive points. The second cover element may also be connected analogously to the side elements. Instead of the adhesive bonding points between the elements, the elements could also be kept in operative connection with one another from the outside by means of adhesive bonding strips or via staples. The packaging may furthermore also comprise a plurality of cardboard parts (multipart) which are adhesively bonded to one another or connected in some other way before the folding of the packaging or setting it upright and before the chocolate is packaged.

If required, the packaging may also have cutouts. Cutouts in the base or in the first and second cover element may serve as viewing windows, cutouts in the side elements or the second cover element, if the stability is not impaired, for reducing the weight.

In one embodiment of a packaging according to the invention, the side elements have a C-shaped cross section or C-shaped profile in the inwardly folded state, which cross section or profile has a positive effect in the assembly, in particular in the closed state, on the stability and ultimately contributes to increasing the stability of the packaging. In this case, the side elements are operatively connected to the first and/or the second cover element via second adhesive bonding points in such a manner that a box-like structure of increased stability results. The second adhesive bonding points of the first cover element preferably lie exclusively on the fixing part. The increased stability of the packaging in respect of all types of mechanical forces, for example shearing and bending forces, reduces the probability of the chocolate bar breaking in the packaging. Furthermore, the C-shaped profile may be selected in such a manner that there is a clearance of, for example, up to several millimetres between the chocolate and the inside of the packaging in the folded state. In this case, mechanical compressive forces or weights, for example during stacking or storage, are absorbed by the packaging, in particular the box-like structure, and therefore there is only a minimal action of force, if any at all, on the chocolate in the interior of the packaging. In countries with high daily temperatures, this can constitute an advantage because the chocolate is not deformed.

The stability of the packaging in the unopened state can be further improved by second adhesive bonding points on the cover. In this case, these adhesive bonding points are advantageously designed to be less strongly adhesive than the adhesive bonding points of the fixing part so that, during opening the flap as a whole can be separated from the fixing part and from the side elements. This makes it possible to prevent the flap from tearing in an undesirable or uncontrolled manner in the region of the operative connection to the side elements, and parts of the flap from remaining operatively connected to the side elements.

A cross-shaped outline of the packaging permits simple packaging of the chocolate bar in terms of production by the packaging being as it were folded around the chocolate. After the chocolate is placed onto the rectangular base of the unfolded packaging, the side elements and the second cover element are folded twice through approx. 90° in each case along the folding lines and, if appropriate, are adhesively bonded to each other or operatively connected to each other in some other manner, for example by means of adhesive bonding strips. Subsequently, the first cover element is likewise folded twice through approx. 90° in each case along the folding lines and adhesively bonded to the first cover element and the side elements. In this case, the adhesive is applied in each case to the adhesive bonding points before the folding operation. As an alternative, the side and cover elements of the unfolded packaging are set upright, i.e. folded once through approx. 90°, before the chocolate is placed in.

In one embodiment, the perforation extends approximately over the entire length of the first cover element, i.e. from a region in which the first cover element overlaps with the one side element into a region in which the first cover element overlaps with the other side element. If, furthermore, a part of the first cover element, which part adjoins the rectangular base, is realized as a flap, then the flap can be opened with respect to the base along the folding lines. Such a packaging is distinguished in respect of the handling by case- or envelope-like properties. In this case, one of the side surfaces of the packaging is completely opened or freely accessible in such a manner that the bar-like chocolate can be removed as a whole from the packaging. During removal and, in particular, during re-insertion or re-supply, the bar-like chocolate is guided and protected by the box-like structure and the C-shaped profile of the side elements.

A further embodiment is distinguished in that the flap is formed by a V-shaped perforation with a bend. In this case, the bend (or a main curvature of the perforation) forms a tab of the flap, which tab can be inserted into the opening in order to re-close the flap or the packaging. The opening is of slot-shaped design in such a manner that the tab is held in its position by the opening. To improve user friendliness, the slot-like opening can have a cutout which is, for example, in the manner of a segment of a circle.

In a further embodiment, the fixing element has a second recess by means of which a part of the flap, for example the tab, is freely accessible laterally. In order to open the flap, the consumer can grasp the tab which is freely accessible laterally from below (along the outside of the fixing element).

If a packaging is to be realized without the opening in the second cover element, the tab may alternatively be designed such that it can be released and re-adhered (is re-adherable) repeatedly without a grasping of the tab from below possibly being obstructed in the process. This can be realized by means of an adhesive surface of the tab that has Post-It®-like properties. Instead of on the tab, the adhesive surface may be arranged in that region of the second cover element which corresponds with the tab. In a further embodiment, at least part of the flap edge region which faces the fixing region (and/or of the fixing element edge region which faces the flap) is designed as an adhesive surface.

An exemplary embodiment of the invention is described with reference to the figures below, in which:

FIG. 1 shows a plan view (layout) of a cardboard packaging 1 for bar-like chocolate, in an unfolded state, FIG. 2 shows the cardboard packaging 1 in a folded or closed, unopened state in a perspective illustration obliquely from the top left, and FIG. 3 shows the cardboard packaging in a perspective illustration in a folded and opened state.

Figure 1:
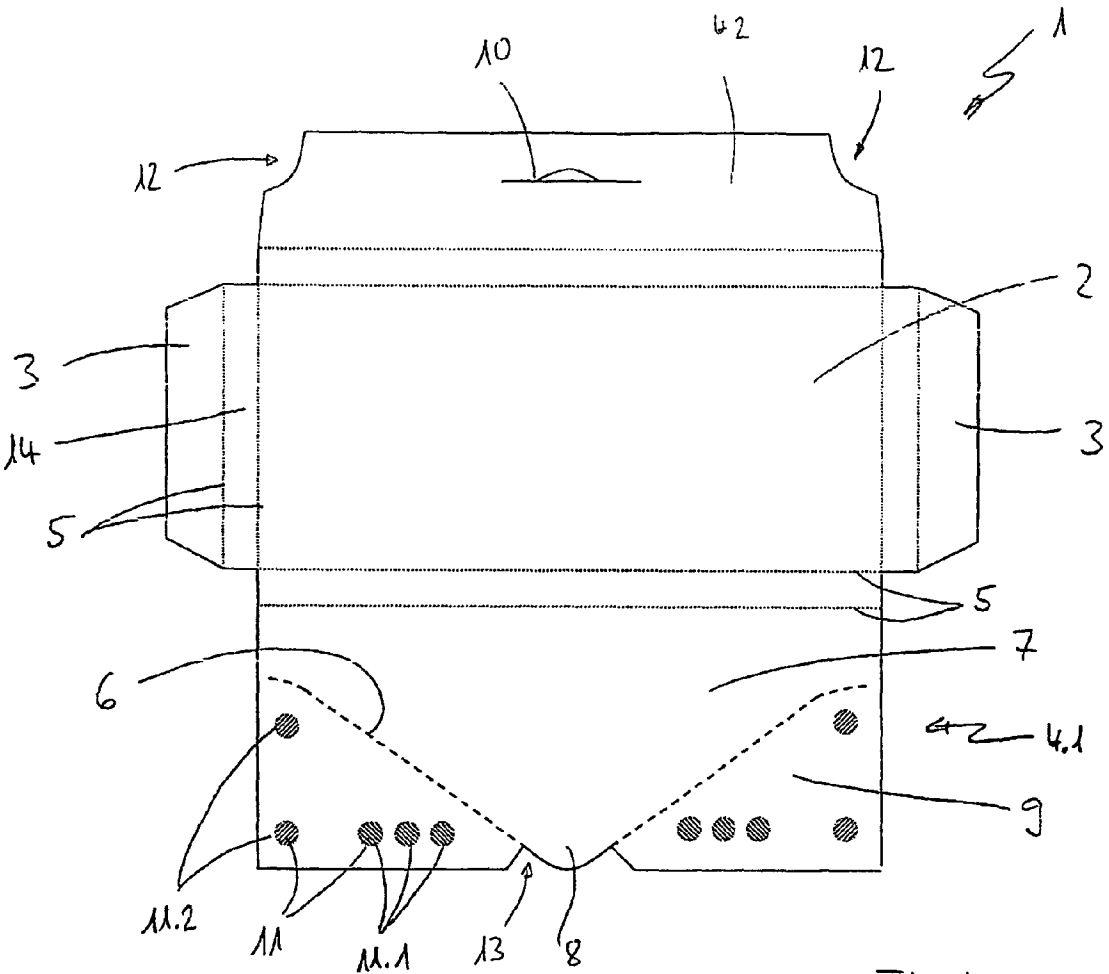
FIG. 1 shows a cardboard packaging in an unfolded state in plan view.

In the unfolded state in FIG. 1, the cardboard packaging 1 has a rectangular base 2 here. Respective side elements 3 are arranged on two opposite sides or edges of the base 2. The side elements are connected to the base 2 via folding lines 5. The side elements 3 can be folded, preferably inwards, along the folding lines 5. The side elements 3 have a trapezium-like shape at the free end and, at the opposite end connected to the base 2, a rectangular shape which is defined by the folding lines 5 and which shape in the folded state forms a side surface 14 of the packaging.

A first and a second cover element 4.1, 4.2 of a cover respectively adjoin one of the two other opposite sides of the base 2. The cover elements 4.1, 4.2 are connected to the base 2 likewise via folding lines 5. The first cover element 4.1 is rectangular and has a perforation 6 which divides the first cover element 4.1 into a flap 7 and a fixing region 9, with the flap 7 directly adjoining the base 2 via the folding lines 5. The second cover element 4.2 is in the manner of a trapezium shape and has an opening 10. The opening 10 is slot-like and is partially widened by a cutout. The free end of the second cover element 4.2 furthermore has two first recesses 12.

The perforation 6 here is of V-shape and symmetrical design and extends in the longitudinal direction on the longitudinal side over approximately the entire length of the first cover element 4.1. The bend or the region of greatest curvature of the perforation 6 is designed as a tab 8 of the flap 7, which tab, in the folded state of the cardboard packaging 1, corresponds with the opening 10 in such a manner that the tab 8 can be inserted into the opening 10 for re-closing (i.e. for multiple or repeated closing) of the flap 7. In the inserted state, the tab 8 is held in position by the opening 10 in a form-fitting or frictional manner.

The tab 8 is designed such that it is freely accessible laterally and such that it can be grasped from below by the fixing region 9 being divided into two halves by a second recess 13. In this case, the tab 8 forms part of the side or edge of the cover. The perforation 6 correspondingly falls into two sections, with a respective section lying on the left and right of the second recess 13.

As viewed in general, the cardboard packaging 1 in the unfolded state has an approximately cross-shaped layout.

FIG. 1 furthermore indicates adhesive bonding points 11 and first and second adhesive bonding points 11.1, 11.2 by means of which the first cover element 4.1, in particular the fixing element 9, the second cover element 4.2 and/or the side elements 3 are operatively connected to one another in a dimensionally stable manner in the folded state.

Figure 2:
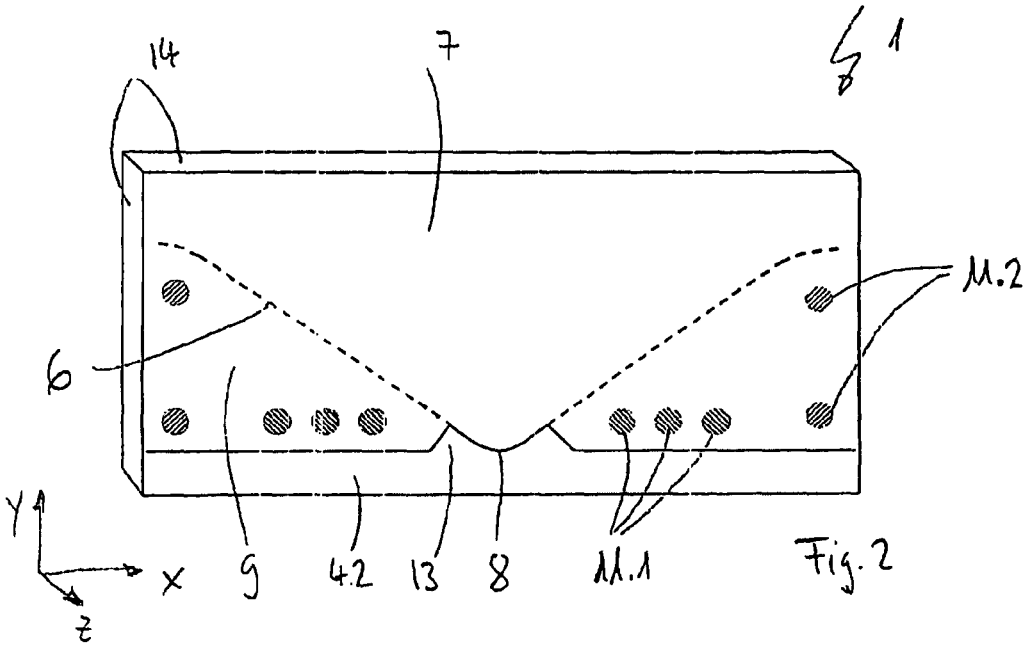
FIG. 2 shows the cardboard packaging in a folded, unopened state in a perspective illustration.
Figure 3:
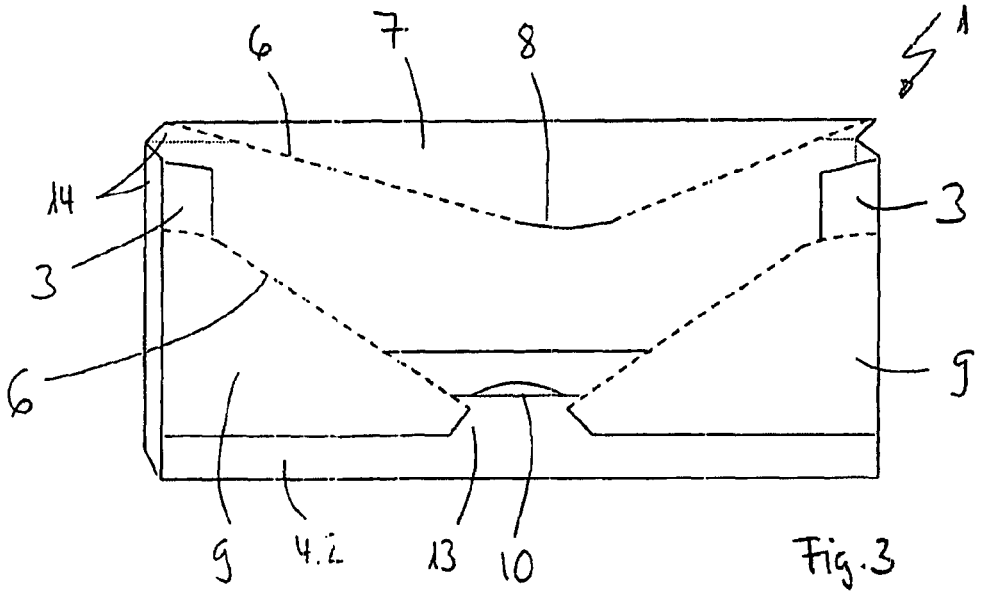
FIG. 3 shows the cardboard packaging in the folded, opened state in a perspective illustration.

The folded state according to FIG. 2 and FIG. 3 shows how, firstly, the side elements 3 are operatively connected to the fixing region 9 via second adhesive bonding points 11.2 (indicated) situated in the interior of the cardboard packaging 1 and, secondly, the fixing region 9 is operatively connected to the second cover element 4.2 via first adhesive bonding points 11.1 (indicated). In this case, in order to improve the stability between the side elements 3 and the fixing region 9, second adhesive bonding points 11.2, which face the free end of the first cover element 4.1, are located in the region of the first recesses 12 and as close as possible to the folding lines 5. The adhesive bonding produces a dimensionally stable, bar-like packaging which in each case has a rectangular cross section both in an x-z peripheral direction, formed by the side elements 3, the base 2 and the first and/or the second cover elements 4.1, 4.2, and in a y-z peripheral direction, formed by the base 2, the first and second cover elements 4.1, 4.2, and additionally in all cases the side elements 3.

In the unopened state according to FIG. 2, the flap 7 is operatively connected to the fixing region 9 along the perforation 6. The perforation 6 extends over the entire length of the first cover element 4.1 and overlaps in the edge region with the side elements 3. The opening 10 is covered by the tab 8 which is freely accessible laterally and, if appropriate, can be grasped from below, i.e. the tab 8 is not inserted into the opening 10. The free accessibility of the tab 8 is realized by the second recess 13.

To open the packaging, the flap 7 is separated or torn from the fixing region 9 along the perforation 6 and folded over along the folding lines 5 (along a virtual axis of rotation which is not fixed in position). To depict this better, the torn-open perforation 6 in FIG. 3 is likewise illustrated by dashed lines. The tearing open renders the opening 10 accessible. In the exemplary embodiment, the flap 7 does not have any adhesive bonding points with the side elements 3. In the opened state in FIG. 3, the tab 8 can be inserted into the opening 10 for reclosing of the flap 7. In the opened state, the flap 7 can be opened along the folding lines 5 until the entire side surface 14 situated between two folding lines 5 is folded away. The interior of the packaging is fully accessible here laterally in such a manner that bar-like chocolate can be removed as a whole from the cardboard packaging 1 or can be inserted back into it again.

In the inwardly folded state, the side elements 3 have a C-shaped cross section or a C-shaped profile (in the x-z direction) and, after being operatively connected to the first and/or the second cover element 4.1, 4.2, form a highly stable box-, case- or envelope-like structure.

LIST OF REFERENCE NUMBERS

1 Packaging
2 Base
3 Side element(s)
4.1 First cover element
4.2 Second cover element
5 Folding line(s)
6 Perforation
7 Flap
8 Tab
9 Fixing region
10 Opening
11 Adhesive bonding point(s)
11.1 First adhesive bonding point(s)
11.2 Second adhesive bonding point(s)
12 First recess(es)
13 Second recess
14 Side surface(s)

The invention claimed is:

1. Packaging for bar-like foodstuffs, having a rectangular base, two side elements which are located on opposite sides of the rectangular base and separated from the base via folding lines and are folded inwards along the folding lines, and a first and a second cover element which are each located on one of the two other opposite sides of the rectangular base, separated from the latter via folding lines, and which partially overlap with the two side elements in the folded state, the first cover element comprising a flap and a fixing region and having a perforation so that the flap can be separated from the fixing region, the fixing region being operatively connected in a folded state to the second, opposite cover element via first adhesive bonding points on the fixing region, and the fixing region being operatively connected in a folded state to the side elements via second adhesive bonding points on the fixing region that are spaced apart from each other, and the second cover element having an opening into which a tab of the flap can be inserted for re-closing of the packaging.

2. Packaging according to claim 1, wherein the side elements and a portion of the base form a C-shaped cross section when the side elements are in an inwardly folded state, and the side elements are operatively connected to the first cover element via the second adhesive bonding points in such a manner that a box-like structure of the packaging results.

3. Packaging according to claim 1, wherein the perforation extends in a longitudinal direction over an entire length of the first cover element.

4. Packaging according to claim 1, wherein the flap can be opened with respect to the rectangular base along the folding lines between the first cover element and the base.

5. Packaging according to claim 1, wherein the first adhesive bonding points are positioned in a longitudinal direction, and the second adhesive bonding points are spaced apart from each other in a latitudinal direction.

6. Packaging according to claim 1, wherein the opening is designed as a slot with a segment-like cutout.

7. Packaging according to claim 1, wherein the perforation is V-shaped.

8. Packaging according to claim 1, wherein a bend in the perforation forms the tab.

9. Packaging according to claim 1, wherein the tab is freely accessible laterally and/or can be grasped from below.

10. Packaging according to claim 1, wherein inserting the tab into the opening after the perforation has been torn connects the flap to the second cover element.

11. Packaging according to claim 1, wherein the perforation is designed so as to indicate tampering.

12. Packaging according to claim 1, wherein the perforation is visible from the outside.

13. Packaging according to claim 1, wherein the perforation is formed by one or more slots.

14. Packaging comprising a rectangular base, two side elements which are located on opposite sides of the rectangular base and connected to the base via folding lines, and a first and second cover element connected to the base via folding lines, and which at least partially overlap with the two side elements when in a folded state, the first cover element having a perforation so that a flap can be separated from a fixing region, the fixing region being connected, in the folded state, to the second cover element via first adhesive bonds, the fixing region being connected, in the folded state, to the side elements by second adhesive bonds that are non-contiguous, and the second cover element having an opening into which a tab of the flap can be inserted, for re-closing of the packaging.

15. The packaging of claim 14 wherein the second adhesive bonds are positioned perpendicular to the first adhesive bonds.

* * * * *